US006282888B1

(12) United States Patent
Sealy et al.

(10) Patent No.: US 6,282,888 B1
(45) Date of Patent: Sep. 4, 2001

(54) METHOD AND SYSTEM FOR COMPENSATING FOR DEGRADED PRE-CATALYST OXYGEN SENSOR IN A TWO-BANK EXHAUST SYSTEM

(75) Inventors: Brent Edward Sealy, Dearborn; Kenneth John Behr, Farmington Hills; Richard Andrew Booth, Canton, all of MI (US)

(73) Assignee: Ford Technologies, Inc., Dearborn, MI (US)

( * ) Notice: Subject to any disclaimer, the term of this patent is extended or adjusted under 35 U.S.C. 154(b) by 0 days.

(21) Appl. No.: 09/488,418

(22) Filed: Jan. 20, 2000

(51) Int. Cl.[7] ..... F01N 3/00

(52) U.S. Cl. ..... 60/274; 60/277; 60/285

(58) Field of Search ..... 60/274, 276, 277, 60/285; 123/690, 691, 692

(56) References Cited

U.S. PATENT DOCUMENTS

| | | | | |
|---|---|---|---|---|
| 4,777,922 | * | 10/1988 | Mieno et al. | 123/690 |
| 5,074,113 | | 12/1991 | Matsuoka . | |
| 5,154,054 | * | 10/1992 | Nakane et al. | 60/276 |
| 5,207,057 | | 5/1993 | Kayanuma . | |
| 5,228,287 | | 7/1993 | Kuronishi et al. . | |
| 5,233,829 | | 8/1993 | Komatsu . | |
| 5,247,793 | | 9/1993 | Yamada et al. . | |
| 5,255,512 | | 10/1993 | Hamburg et al. . | |
| 5,279,114 | | 1/1994 | Kurita et al. . | |
| 5,282,360 | | 2/1994 | Hamburg et al. . | |

(List continued on next page.)

FOREIGN PATENT DOCUMENTS 6-167210 * 6/1994 (JP) .

OTHER PUBLICATIONS

U.S.P.A. for "Method And System For Controlling Air/Fuel Level In Two–Bank Exhaust System" filed on the same date hereof; Inventors: Booth, et al.; Attorney Docket No. 199–1619 (65080–0006).

U.S.P.A. for "Method And System For Controlling Air/Fuel Level For Internal Combustion Engine With Two Exhaust Banks" filed on the same date hereof; Inventors: Booth, et al.; Attorney Docket No. 199–1772 (65080–0007).

U.S.P.A. for "A Method for Controlling Air/Fuel mixture" filed on the same date hereof; Inventors: Booth, et al.; Attorney Docket No. 199–1803 (65080–0009).

U.S.P.A. for "Diagnostic System For Detecting Catalysts Failure Using Switch Ratio" filed on the same date hereof; Inventors: Booth, et al.; Attorney Docket No. 199–1788 (65080–0009).

U.S.P.A. for "Diagnostic System For Monitoring Catalyst Operation Using Arc Length Ratio" filed on the same date hereof; Inventors: Booth, et al.; Attorney Docket No. 199–1790 (65080–0010).

*Primary Examiner*—Thomas Denion
*Assistant Examiner*—Tu M. Nguyen
(74) *Attorney, Agent, or Firm*—John F. Buckert

(57) ABSTRACT

A method and system for controlling the air/fuel ratio in an internal combustion engine having first and second groups of cylinders coupled to first and second exhaust banks, respectively. Each exhaust bank has a catalyst, a pre-catalyst oxygen sensor and a post-catalyst oxygen sensor, wherein the oxygen sensors monitor the air/fuel ratio in their respective exhaust banks and provide corresponding feedback signals to a controller. The controller uses the feedback signals to control the air/fuel ratio in the engine cylinders. When it is detected that one or the other of the pre-catalyst oxygen sensors has degraded, the controller calculates A/F values for the group of cylinders corresponding to the exhaust bank having a degraded EGO sensor based on feedback signals from the three still-functional oxygen sensors.

10 Claims, 3 Drawing Sheets

U.S. PATENT DOCUMENTS

| | | | | |
|---|---|---|---|---|
| 5,318,003 | * | 6/1994 | Kadota | 60/276 |
| 5,359,852 | | 11/1994 | Curran et al. . | |
| 5,377,484 | | 1/1995 | Shimizu . | |
| 5,394,691 | | 3/1995 | Seki . | |
| 5,396,765 | * | 3/1995 | Maruyama et al. | 60/276 |
| 5,417,058 | | 5/1995 | Shimizu . | |
| 5,450,837 | | 9/1995 | Uchikawa . | |
| 5,485,382 | | 1/1996 | Seki et al. | 60/285 |
| 5,511,377 | | 4/1996 | Kotwicki . | |
| 5,570,574 | | 11/1996 | Yamashita et al. . | |
| 5,704,339 | | 1/1998 | Choe et al. . | |
| 5,706,793 | | 1/1998 | Orzel et al. . | |
| 5,749,221 | | 5/1998 | Kawahira et al. . | |
| 5,894,727 | | 4/1999 | Zimlich . | |
| 5,899,062 | | 5/1999 | Jerger et al. . | |
| 5,979,160 | * | 11/1999 | Yashiki et al. | 60/276 |
| 6,112,731 | * | 9/2000 | Linenberg et al. | 60/274 |
| 6,151,889 | * | 11/2000 | Davey et al. | 60/277 |

* cited by examiner

METHOD AND SYSTEM FOR COMPENSATING FOR DEGRADED PRE-CATALYST OXYGEN SENSOR IN A TWO-BANK EXHAUST SYSTEM

TECHNICAL FIELD OF THE INVENTION

The present invention relates generally to electronic control of an internal combustion engine having first and second groups of cylinders. In particular, this invention relates to a system and method of controlling the air/fuel ratio in the second group of cylinders based on a feedback signal received from an oxygen exhaust sensor located downstream of the second group of cylinders and a feedback signal from at least one exhaust gas oxygen sensor located downstream of the first group of cylinders.

BACKGROUND

To meet current emission regulations, automotive vehicles must regulate the air/fuel ratio (A/F) supplied to the vehicles' cylinders so as to achieve maximum efficiency of the vehicles' catalysts. For this purpose, it is known to control the air/fuel ratio of internal combustion engines using an exhaust gas oxygen (EGO) sensor positioned in the exhaust stream from the engine. The EGO sensor provides feedback data to an electronic controller that calculates preferred A/F values over time to achieve optimum efficiency of a catalyst in the exhaust system. It is also known to have systems with two EGO sensors in the exhaust stream in an effort to achieve more precise A/F control with respect to the catalyst window. Normally, a pre-catalyst EGO sensor is positioned upstream of the catalyst and a post-catalyst EGO sensor is positioned downstream of the catalyst. Finally, in connection with engines having two groups of cylinders, it is known to have a two-bank exhaust system coupled thereto where each exhaust bank has a catalyst as well as pre-catalyst and post-catalyst EGO sensors. Each of the exhaust banks corresponds to a group of cylinders in the engine. The feedback signals received from the EGO sensors are used to calculate the desired A/F values in their respective group of cylinders at any given time. The controller uses these desired A/F values to control the amount of liquid fuel that is injected into the cylinders by the vehicle's fuel injector. It is a known methodology to use the EGO sensor feedback signals to calculate desired A/F values that collectively, when viewed against time, form A/F waveforms having ramp portions, jumpback portions and hold portions, as shown in FIG. 3.

Sometimes, in a two-bank, four-EGO sensor exhaust system, one of the pre-catalyst EGO sensors degrades. In such case, it is desirable to be able to control the A/F in the group of cylinders coupled to the exhaust bank having only one operational EGO sensor by using the feedback signals received from the three operational EGO sensors alone. It is a known methodology to compensate for a degraded pre-catalyst EGO sensor in one of the exhaust banks by having the A/F values in the corresponding group of cylinders mirror the A/F values in the other group of cylinders. Essentially, this known methodology simply calculates desired A/F values over time for the group of cylinders coupled to two properly functioning EGO sensors and uses those A/F values for both banks. But this methodology fails to utilize the feedback signal provided by the post-catalyst EGO sensor in the exhaust bank having the degraded pre-catalyst EGO sensor. Therefore, the A/F values applied to the group of cylinders coupled to the degraded pre-catalyst EGO sensor do not benefit from any feedback signal specific to that bank, and, as a result, the A/F values used in that group of cylinders may not be optimal to enable the corresponding catalyst to perform most efficiently.

Therefore, it is desirable to have an improved methodology and system for calculating A/F values for a group of cylinders coupled to an exhaust bank having a degraded pre-catalyst EGO sensor. The improved methodology and system should utilize the feedback signal received from the post-catalyst EGO sensor in the exhaust bank having the degraded pre-catalyst EGO sensor to calculate more responsive A/F values and thus enable the catalyst to operate more efficiently.

SUMMARY OF THE INVENTION

The present invention is directed toward a new methodology and system for controlling the A/F level in one of two groups of cylinders in an internal combustion engine by using a feedback signal from an EGO sensor coupled downstream of that group of cylinders and a feedback signal from at least one EGO sensor coupled downstream of the other group of cylinders. In an engine having two groups of cylinders coupled to a two-bank four EGO sensor exhaust system, the present invention calculates preferred A/F values for the second group of cylinders when the pre-catalyst EGO sensor in the second bank degrades. The A/F values for the second bank are calculated by a controller based on feedback signals received from the pre-catalyst EGO sensor and the post-catalyst EGO sensor coupled to the first group of cylinders and a feedback signal received from the post-catalyst EGO sensor coupled to the second group of cylinders.

Specifically, a controller in the present invention uses well-known methodologies to generate preferred A/F values for the group of cylinders coupled to two functioning EGO sensors (the "First Bank"). The controller, in cooperation with a fuel injector, uses those A/F values to control the amount of liquid fuel that is injected into those cylinders, according to well-known methods. The preferred A/F values, when graphed against time, form an A/F waveform. The preferred waveform includes ramp portions, jumpback portions and hold portions, as is known in the art, though this invention can also be used in connection with a variety of different A/F waveforms. The controller uses a feedback signal provided by the post-catalyst EGO sensor of the exhaust bank having just one functioning EGO sensor (the "Second Bank") to modify the A/F values calculated for the First Bank, thereby generating A/F values for the Second Bank. According to a preferred embodiment of this invention, the A/F values for the second Bank mirror the corresponding A/F values in the First Bank during the ramp and jumpback portions of the A/F waveforms. However, the A/F level in the Second Bank is made responsive to its operational post-catalyst EGO sensor by adjusting the hold portion of the A/F waveform based on a feedback signal from the post-catalyst EGO sensor in the Second Bank.

The disclosed methods and systems provide more responsive A/F values, and, as a result, permit the catalyst in the Second Bank to operate more efficiently compared to the known method of mirroring the A/F values in the two banks without using any feedback from the post-catalyst sensor in the Second Bank.

DETAILED DESCRIPTION OF THE PREFERRED EMBODIMENT

Figure 1:
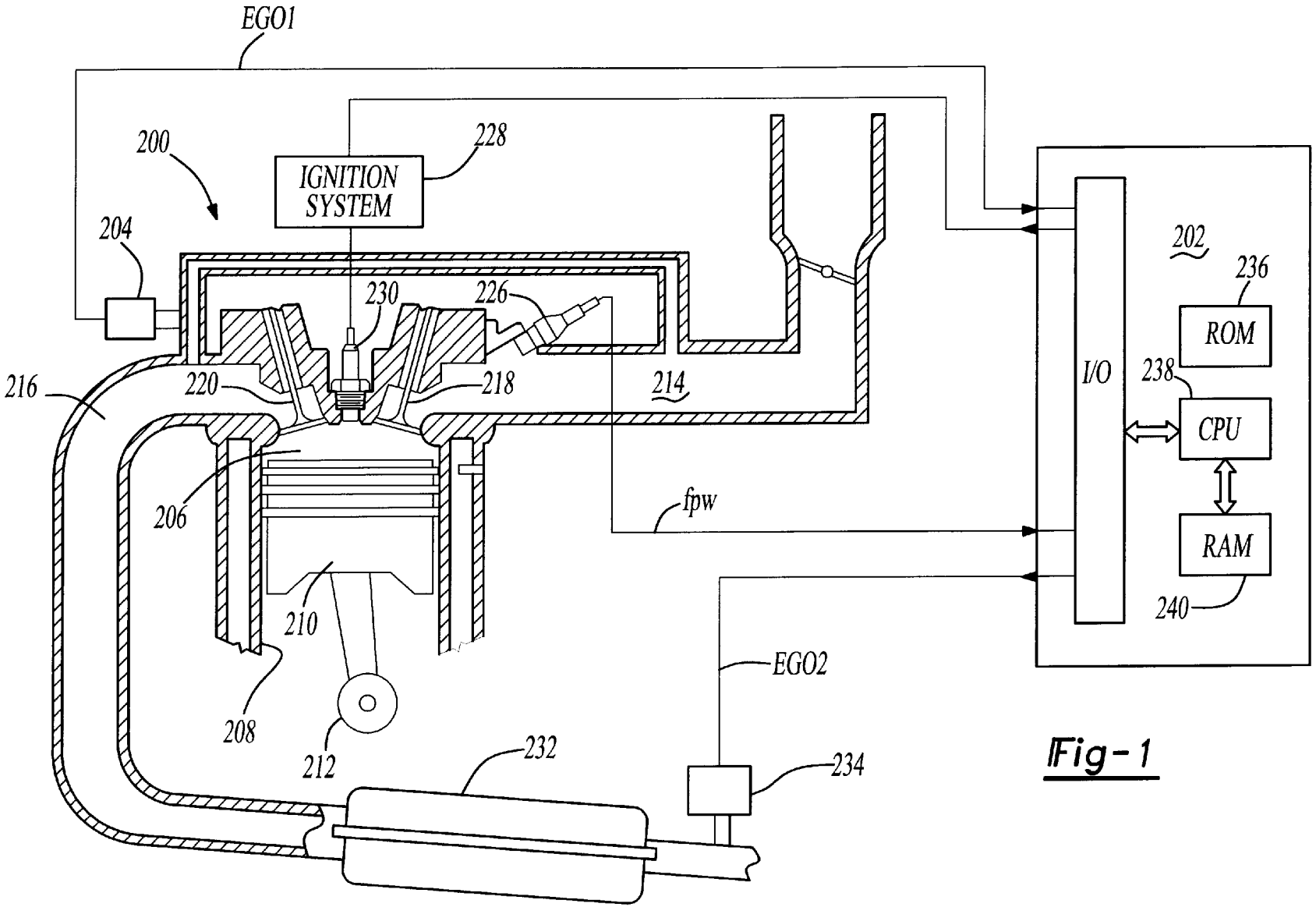
FIG. 1 illustrates an internal combustion engine, according to a preferred embodiment of the invention.

FIG. 1 illustrates an internal combustion engine. Engine 200 generally comprises a plurality of cylinders, but, for illustration purposes, only one cylinder is shown in FIG. 1. Engine 200 includes combustion chamber 206 and cylinder walls 208 with piston 210 positioned therein and connected to crankshaft 212. Combustion chamber 206 is shown communicating with intake manifold 214 and exhaust manifold 216 via respective intake valve 218 and exhaust valve 220. As described later herein, engine 200 may include multiple exhaust manifolds with each exhaust manifold corresponding to a group of engine cylinders. Intake manifold 214 is also shown having fuel injector 226 coupled thereto for delivering liquid fuel in proportion to the pulse width of signal FPW from controller 202. Fuel is delivered to fuel injector 226 by a conventional fuel system (not shown) including a fuel tank, fuel pump, and fuel rail (not shown).

Conventional distributorless ignition system 228 provides ignition spark to combustion chamber 206 via spark plug 230 in response to controller 202. Two-state EGO sensor 204 is shown coupled to exhaust manifold 216 upstream of catalyst 232. Two-state EGO sensor 234 is shown coupled to exhaust manifold 216 downstream of catalyst 232. EGO sensor 204 provides a feedback signal EGO to controller 202 which converts signal EGO into two-state signal EGOS1. A high voltage state of signal EGOS1 indicates exhaust gases are rich of a reference A/F and a low voltage state of converted signal EGO1 indicates exhaust gases are lean of the reference A/F. EGO sensor 234 provides signal EGO2 to controller 202 which converts signal EGO2 into two-state signal EGOS2. A high voltage state of signal EGOS2 indicates exhaust gases are rich of a reference air/fuel ratio and a low voltage state of converted signal EGO1 indicates exhaust gases are lean of the reference A/F. Controller 202 is shown in FIG. 1 as a conventional microcomputer including: microprocessor unit 238, input/output ports 242, read only memory 236, random access memory 240, and a conventional data bus.

Figure 2:
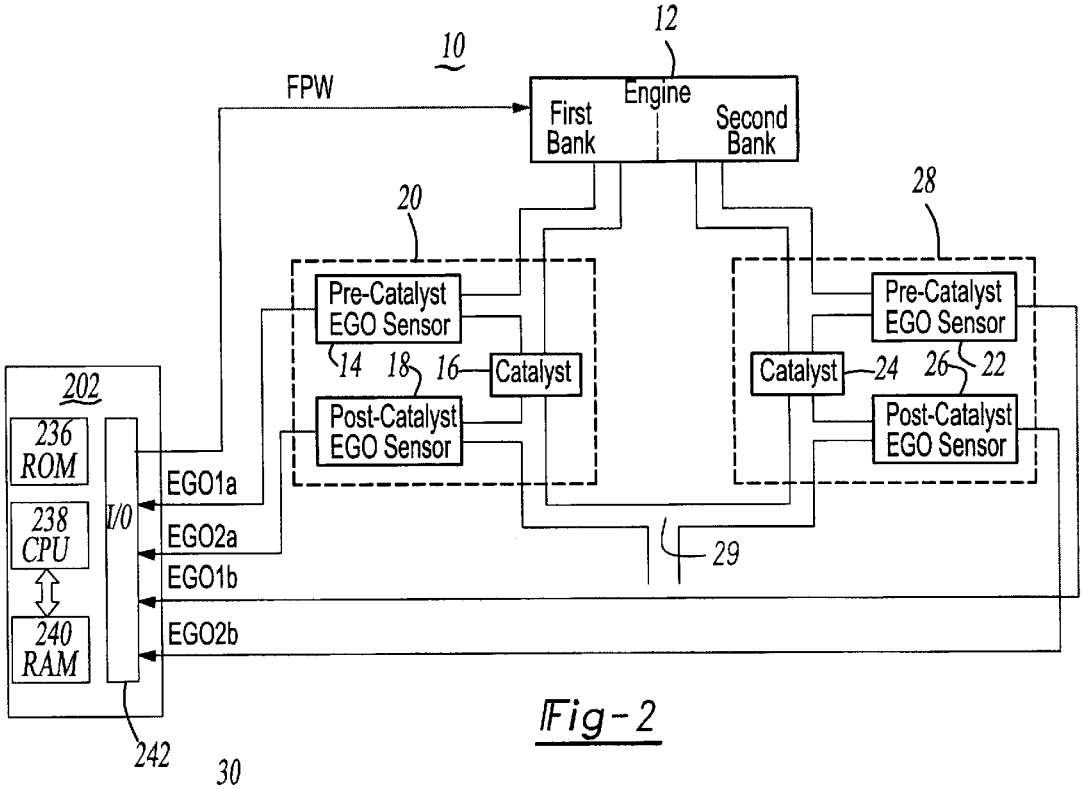
FIG. 2 shows a schematic representation of a well-known two-bank exhaust system with each bank having pre-catalyst and post-catalyst EGO sensors.

FIG. 2 shows a well-known two-bank, four-EGO-sensor exhaust system. As illustrated in FIG. 2, exhaust gases flow from first and second groups of cylinders of engine 12 through a corresponding first exhaust bank 20 and second exhaust bank 28. Engine 12 is the same as or similar to engine 200 in FIG. 1. Exhaust bank 20 includes pre-catalyst EGO sensor 14, catalyst 16, and post-catalyst EGO sensor 18. Exhaust bank 28 includes pre-catalyst EGO sensor 22, catalyst 24 and post-catalyst EGO sensor 26. The pre-catalyst EGO sensors, catalysts, and post-catalyst EGO sensors in FIG. 2 are the same as or similar to pre-catalyst EGO sensor 204, catalyst 232, and post-catalyst EGO sensor 234 in FIG. 1.

In operation, when exhaust gases flow from engine 12 through exhaust bank 20, pre-catalyst EGO sensor 14 senses the level of oxygen in the exhaust gases passing through bank 20 prior to them entering catalyst 16 and provides feedback signal EGO1*a* to controller 202. After the exhaust gases pass through catalyst 16, post-catalyst EGO sensor 18 senses the level of oxygen in the exhaust gases subsequent to exiting catalyst 16 and provides feedback signal EGO2*a* to controller 202. With respect to exhaust bank 28, pre-catalyst EGO sensor 22 senses the level of oxygen in the exhaust gases passing through bank 28 prior to them entering catalyst 24 and provides feedback signal EGO1*b* to controller 202. After the exhaust gases pass through catalyst 24, post-catalyst EGO sensor 26 senses the level of oxygen in the exhaust gases subsequent to exiting catalyst 24 and provides feedback signal EGO2*b* to controller 202. Then the exhaust gases are joined at junction 29 before being expelled from the system 10, though the disclosed invention is equally applicable to a system wherein the exhaust banks are maintained separate throughout the entire system. Controller 202 uses feedback signals EGO1*a*, EGO1*b*, EGO2*a*, and EGO2*b* to calculate preferred A/F values and uses these values to control the amount of liquid fuel that is introduced into the groups of cylinders through signal FPW. The controller shown in FIG. 2 is the same as or similar to controller 202 shown in FIG. 1.

It should be recognized that the present invention can be used in connection with a two-bank exhaust system similar to that shown in FIG. 2, but where the bank 20 only has a pre-catalyst EGO sensor 14. That is, the present invention is applicable to two-bank exhaust systems that have (i) a first exhaust bank having a catalyst and a pre-catalyst EGO sensor, and (ii) a second exhaust bank having a catalyst, a pre-catalyst EGO sensor, and a post-catalyst EGO sensor. In such systems, well-known methodologies are used to control the A/F levels in the first group of cylinders based on a feedback signal from only a single pre-catalyst EGO sensor. Then, if the system detects a degradation in the pre-catalyst EGO sensor in the second bank, A/F values for the second group of cylinders are calculated by modifying the A/F values for the first group of cylinders based on a feedback signal from the post-catalyst EGO sensor in the second bank, according to the present invention.

Figure 3:
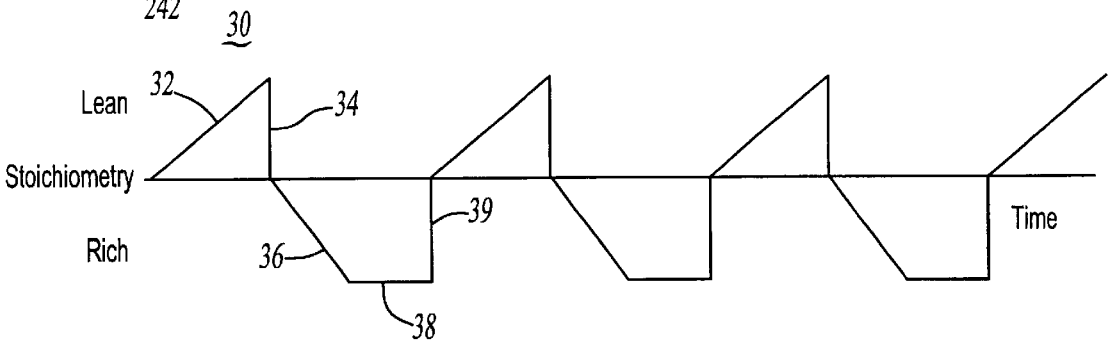
FIG. 3 shows a preferred A/F waveform for a group of cylinders calculated according to well-known techniques using feedback signals from both a pre-catalyst EGO sensor and a post-catalyst EGO sensor.

Generally, to achieve the most efficient operation of the catalysts, it is desirable to oscillate the A/F in a group of cylinders around stoichiometry so that the A/F is sometimes rich and sometimes lean relative to stoichiometry. As is well-known in the art, the A/F in a group of cylinders can be controlled by varying the rich and lean A/F levels and the amount of time during which those rich and lean levels are held. FIG. 3 illustrates a typical preferred A/F waveform 30 over time that shows A/F levels being held at rich and lean levels for certain lengths of time to control the A/F level in a group of engine cylinders coupled to two properly-functioning EGO sensors. This A/F waveform 30 represents the desired A/F waveform used to control the A/F level in the group of cylinders corresponding to exhaust bank 20 of FIG. 2. Methodologies for determining such a waveform based on the feedback signals from pre-catalyst and post-catalyst EGO sensors are well-known in the art and are described in more detail in U.S. Pat. No. 5,282,360 and U.S. Pat. No. 5,255,512, for example. While the A/F waveform 30 shown in FIG. 2 is a preferred A/F waveform for exhaust bank 20, the disclosed invention also is applicable to other A/F waveforms that may be used.

As can be seen from the preferred A/F waveform in FIG. 3, the desired A/F level steadily rises over time, becoming more and more lean, until the EGO sensors detect a lean A/F state in the exhaust. This portion of the A/F waveform is referred to as a ramp portion 32 because the AIF level is being ramped up during this time period. After the EGO sensors detect that the A/F has reached a particular lean threshold value, the A/F is abruptly dropped toward or past stoichiometry. In the preferred embodiments of the invention, the A/F is dropped to a level approximately equal to stoichiometry. This portion of the waveform is referred to as a jumpback portion 34 because of the abrupt return of the A/F toward stoichiometry. Then, the A/F steadily decreases, becoming more and more rich, until the A/F reaches a particular rich threshold value. Similar to when the A/F steadily increases, this portion of the waveform is referred to as a ramp portion 36. Finally, after the EGO sensors detect that the A/F has decreased to a rich A/F state, the A/F is jumped to and held at a particular A/F level that delivers a desired level of rich bias. This portion of the A/F waveform is referred to as a hold portion 38. After the hold portion, the A/F level jumps back 39 toward stoichiometry, and the process is repeated. The A/F waveform 30 depicted in FIG. 3 is typical of a preferred waveform for a group of cylinders coupled to an exhaust bank having two EGO sensors, like bank 20 of FIG. 2. When all of the EGO sensors of the system 10 are functioning properly, the A/F waveforms for both groups of cylinders would be similar, thought not necessarily identical. Controller 202 calculates the desired A/F ramp slope, the jumpback values, and the hold values based on feedback signals EGO2*a* and EGO1*b* received from EGO sensors 14 and 18, respectively.

Now, for purposes of describing a preferred embodiment of the invention, we assume that pre-catalyst EGO sensor 22 of bank 28 degrades, though this invention works equally well regardless of which of the two pre-catalyst EGO sensors 14, 22 degrades. First, the fact that EGO sensor 22 has degraded is detected by controller 202 using well-known methodologies. In the event that EGO sensor 22 degrades, the normal methodologies for generating the A/F waveform for bank 28 are no longer applicable because they depend upon receiving and utilizing a feedback signal from a pre-catalyst EGO sensor 22. Therefore, after controller 202 detects that EGO sensor 22 has degraded, the A/F values for the group of cylinders corresponding to bank 28 are calculated by using the A/F values generated for the group of cylinders corresponding to bank 20 (using well-known methodologies) and modifying some of them according to feedback signal EGO2b received from post-catalyst EGO sensor 26. In particular, the waveform 40 corresponding to bank 28 utilizes the same ramp portion 32 as that calculated for bank 20. That is, the A/F values for the ramp portions 42, 44 corresponding to bank 28 are copied from the A/F values for the ramp portion 32, 36 corresponding to bank 20. Similarly, the A/F values for the jumpback portions 43, 46 corresponding to bank 28 are copied from the calculated jumpback portions 34, 39 corresponding to bank 20. However, the hold portion 45 corresponding to bank 28 is calculated based on feedback signal EGO2*b* from post-catalyst EGO sensor 26. Feedback signal EGO 2*b* is used to modify the hold portion 38 corresponding to bank 20 to generate a hold portion 45 corresponding to bank 28.

Figure 4:
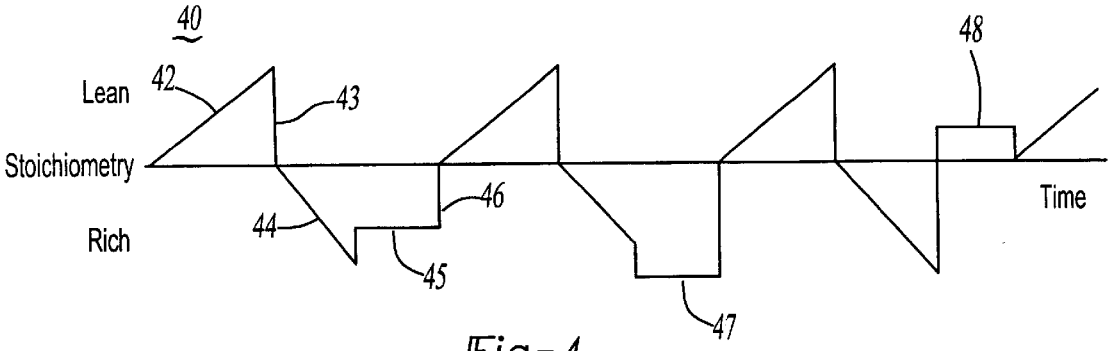
FIG. 4 shows an A/F waveform for a group of cylinders coupled to an exhaust bank having a degraded pre-catalyst EGO sensor, according to a preferred embodiment of the invention.

Specifically, the A/F value corresponding to the hold portion 45 is generated by adjusting the A/F value corresponding to the hold portion 38 either lean or rich, depending upon feedback signal EGO2*b*. If feedback signal EGO2*b* indicates that the A/F level is too rich in bank 28, then the A/F level during the hold portion is adjusted in the lean direction, as shown at 45 in FIG. 4. In some such cases, the A/F adjustment will be large enough so that the A/F level during the hold portion passes stoichiometry and is set to a lean bias, as shown at 48 in FIG. 4. If, on the other hand, feedback signal EGO2*b* indicates that the A/F level is too lean in bank 28, then the A/F level during the hold portion is adjusted in the rich direction, as shown at 47 in FIG. 4. The amount of adjustment either in the lean or rich direction, referred to as the total A/F bias, is determined by controller 202 based on feedback signal EGO2*b*. Controller 202 uses the calculated A/F values to control the A/F in the engine via signal FPW to fuel injector 226, as shown in FIG. 1 and as is well-known in the art.

Figure 5:
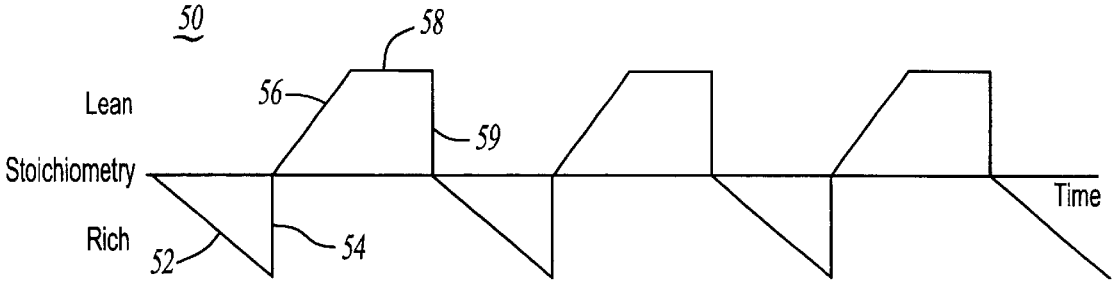
FIG. 5 shows an alternative A/F waveform for a group of cylinders calculated according to well-known techniques using feedback signals from both a pre-catalyst sensor and a post-catalyst EGO sensor.
Figure 6:
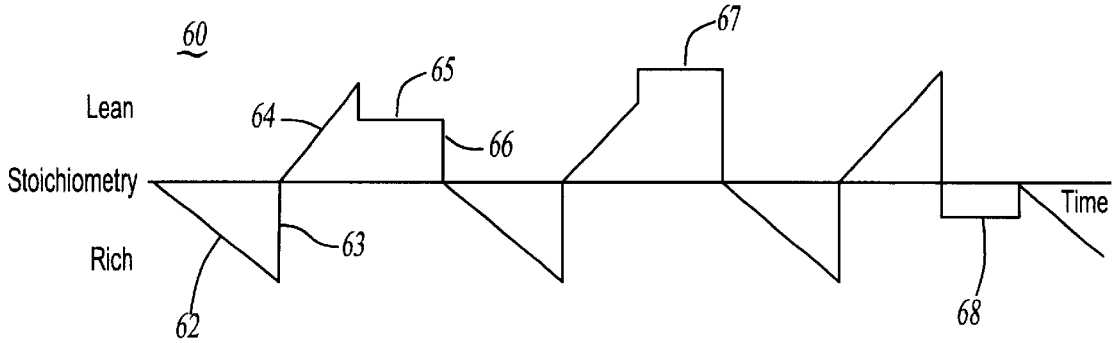
FIG. 6 shows an A/F waveform for a group of cylinders coupled to an exhaust bank having a degraded pre-catalyst EGO sensor, according to an alternative embodiment of the present invention.

FIG. 5 and FIG. 6 illustrate an alternative embodiment of the disclosed invention. FIG. 5 shows an alternative A/F waveform 50 that can be used to control the A/F and oscillate the A/F around stoichiometry in a group of cylinders coupled to two EGO sensors. The A/F waveform 50 shown in FIG. 5, like A/F waveform 30, is generated by control module 202 based upon feedback signals received from both a pre-catalyst EGO sensor and a post-catalyst EGO sensor using methods that are well-known in the art. The material difference between the waveform 30 in FIG. 3 and the waveform 50 in FIG. 5 is that the hold portion 58 in waveform 50 occurs on the lean side of stoichiometry as opposed to the rich side as in waveform 30. Like waveform 30, waveform 50 includes a ramp portion 52, a jumpback portion 54, a ramp portion 56, a hold portion 58, and a jumpback portion 59.

FIG. 6 illustrates a calculated A/F waveform 60 for exhaust bank 28, according to the present invention, in the event that pre-catalyst EGO sensor 22 degrades and exhaust bank 20 utilizes a waveform 50 such as the one shown in FIG. 5. As explained in more detail hereinabove, the ramp portions 52, 56 and the jumpback portions 54, 59 of waveform 50 are copied and used as the ramp portions 62, 64 and jumpback portions 63, 66 in waveform 60. Then, the hold portions 65, 67, 68 are calculated for waveform 60 based on feedback signal EGO2*b* received from post-catalyst EGO sensor 26.

While preferred embodiments of the present invention have been described herein, it is apparent that the basic construction can be altered to provide other embodiments which utilize the processes and compositions of this invention. Therefore, it will be appreciated that the scope of this invention is to be defined by the claims appended hereto rather than by the specific embodiments which have been presented hereinbefore by way of example.

What is claimed is:

1. A method for controlling fuel injection in an engine having a first group of cylinders and a second group of cylinders coupled to a first catalyst and a second catalyst respectively, the method comprising:

detecting a degradation of a pre-catalyst EGO sensor located upstream of the second catalyst;

generating a first feedback signal from a first EGO sensor located upstream of the first catalyst;

generating a second feedback signal from a second EGO sensor that monitors exhaust passing primarily through the second catalyst without being mixed with exhaust passing through the first catalyst; and adjusting a fuel injection amount into the second group of cylinders based on said first feedback signal and said second feedback signal.

2. The method of claim 1, further comprising the steps:

generating a third feedback signal from a third EGO sensor located downstream of the first catalyst; and controlling a fuel injection amount into the first group of cylinders based on said first feedback signal and said third feedback signal.

3. The method of claim 1, further comprising the step of generating a first A/F waveform correspond to the first group of cylinders based on said first feedback signal, and wherein said step of adjusting a fuel injection amount comprises the step of generation a second A/F waveform corresponding to the second group of cylinders.

4. The method of claim 3, wherein said step of generating a second A/F waveform comprises the steps:

duplicating portions of said first A/F waveform to use as corresponding portions of said second A/F waveform; and generating a portion of said second bank A/F waveform based on said second feedback signal.

5. The method of claim 4, wherein said step of generating a first A/F waveform comprises the steps:

generating a first A/F ramp slope corresponding to the first group of cylinders;

generating a first A/F jumpback value corresponding to the first group of cylinders; and generating a first A/F hold value corresponding to the first group of cylinders.

6. The method of claim 5, wherein said step of duplicating portions of said first bank A/F waveform comprises the steps:

duplicating said first A/F ramp slope; and duplicating said first A/F jumpback value.

7. The method of claim 6, wherein said step of generating a portion of said second A/F waveform based on said second feedback signal comprises the step of generating a second A/F hold value based on said second feedback signal.

8. The method of claim 7, wherein said step of generating a second A/F hold value comprises adjusting said first A/F hold value either rich or lean depending on said second feedback signal.

9. A control system for controlling fuel injection in an engine having a first group of cylinders and a second group of cylinders coupled to a first catalyst and a second catalyst respectively, comprising:

means for detecting a degradation of the pre-catalyst oxygen sensor in the second exhaust bank;

a first EGO sensor located upstream of the first catalyst for generating a first feedback signal;

a second EGO sensor located downstream of the second catalyst for generating a second feedback signal based on a composition of exhaust passing primarily through the second catalyst without being mixed with exhaust passing through the first catalyst; and a controller coupled to the engine and said first and second EGO sensors for adjusting a fuel injection amount into the second group of cylinders based on said first feedback signal and said second feedback signal.

10. The control system of claim 9, wherein said means for detecting a degradation of the pre-catalyst EGO sensor in the second exhaust bank comprises said controller.

* * * * *

UNITED STATES PATENT AND TRADEMARK OFFICE

CERTIFICATE OF CORRECTION

PATENT NO. : 6,282,888 B1
DATED : September 4, 2001
INVENTOR(S) : Brent E. Sealy et al.

It is certified that error appears in the above-identified patent and that said Letters Patent is hereby corrected as shown below:

Column 7,
Line 8, replace "correspond" with -- corresponding --.
Line 11, replace "generation" with -- generating --.

Signed and Sealed this

Twelfth Day of March, 2002

*Attest:*

*Attesting Officer*

JAMES E. ROGAN
*Director of the United States Patent and Trademark Office*